US007828921B2

(12) United States Patent
Neuhofer

(10) Patent No.: US 7,828,921 B2
(45) Date of Patent: Nov. 9, 2010

(54) METHOD OF COATING WITH A TOP COAT A COVERING PROFILE FOR FLOORINGS

(76) Inventor: Martin Neuhofer, Haslau 56, A 4893 Zell am Moos (AT)

( * ) Notice: Subject to any disclaimer, the term of this patent is extended or adjusted under 35 U.S.C. 154(b) by 561 days.

(21) Appl. No.: 11/597,304

(22) PCT Filed: Apr. 20, 2006

(86) PCT No.: PCT/AT2006/000157

§ 371 (c)(1),
(2), (4) Date: Sep. 4, 2007

(87) PCT Pub. No.: WO2006/110934

PCT Pub. Date: Oct. 26, 2006

(65) Prior Publication Data

US 2008/0105372 A1 May 8, 2008

(30) Foreign Application Priority Data

Apr. 20, 2005 (AT) ..... A 659/2005

(51) Int. Cl.
*E04D 1/36* (2006.01)

(52) U.S. Cl. ..... 156/211; 156/212; 156/256; 52/395; 52/465; 52/468

(58) Field of Classification Search ..... 52/461, 52/465, 468, 395; 156/244.18, 244.19
See application file for complete search history.

(56) References Cited

U.S. PATENT DOCUMENTS 2,363,429 A * 11/1944 Lowry ..... 52/396.05
6,517,935 B1 2/2003 Kornfalt et al.
6,921,507 B2 * 7/2005 Suenaga ..... 264/146
2003/0154678 A1 8/2003 Stanchfield

FOREIGN PATENT DOCUMENTS

AT 500 734 3/2006

(Continued)

OTHER PUBLICATIONS

International Search Report.

*Primary Examiner*—Richard Crispino
*Assistant Examiner*—Barbara J. Musser
(74) *Attorney, Agent, or Firm*—Collard & Roe, P.C.

(57) ABSTRACT

The invention relates to a method for coating a cover profile and at least one compensation profile of a cover device, which can be connected to a cover flange of the cover profile and which is used for floor covering provided with a cover layer. The cover layer is stuck to a preprofile prior to the cover profile being produced from the preprofile which is coated by the cover layer. According to the invention, the advantages of the production is that the cover profile and the compensation profile which is connected to the lower side of the cover flange of the cover profile by at least one web, forms the preprofile, such that external surfaces of the preprofile, which form the visible sides of the cover profile and the compensation profile, are covered with protruding strips of the cover layer over the longitudinal edge of the visible sides and that the path passes between the cover profile and the compensation profile after bending the protruding strip areas of the cover layer about the longitudinal edge of the visible sides.

3 Claims, 2 Drawing Sheets

FOREIGN PATENT DOCUMENTS

| | | |
|---|---|---|
| CA | 2 556 610 | 9/2005 |
| DE | 695 18 852 | 3/2001 |
| EP | 0 862 976 | 9/1998 |
| FR | 2 881 157 | 7/2006 |
| WO | WO 96/12857 | 5/1996 |
| WO | WO 03/040492 | 5/2003 |
| WO | WO 2005118976 A1 * | 12/2005 |

* cited by examiner

METHOD OF COATING WITH A TOP COAT A COVERING PROFILE FOR FLOORINGS

CROSS REFERENCE TO RELATED APPLICATIONS

Applicant claims priority under 35 U.S.C. §119 of Austrian Application No. A 659/2005 filed Apr. 20, 2005. Applicant also claims priority under 35 U.S.C. §365 of PCT/AT2006/000157 filed Apr. 20, 2006. The international application under PCT article 21(2) was not published in English.

FIELD OF THE INVENTION

The invention relates to a method of coating with a top coat a covering profile and at least one levelling profile adapted to be adjoined with a covering flange of said covering profile of a covering device for floorings, said top coat being glued onto a pre-profile before the covering profile is worked from the pre-profile coated with said top coat.

DESCRIPTION OF THE PRIOR ART

In order to allow for manufacturing different floor profiles from a pre-profile made from a wooden material and having a top coat glued onto the visible face thereof, it is known (WO 96/12857 A1) to take as a starting material a pre-profile having a substantially rectangular cross section and rounded edges on two opposing sides, said top coat, namely a laminate having hard particles embedded therein for increased resistance to abrasion, being glued in one piece onto the top side and over the rounded edges onto the adjoining long sides of the pre-profile. Out of this coated pre-profile differently profiled floor profiles may then be milled in order to allow for insertion of these floor profiles as transition or levelling profiles in the gap between two floor elements of identical or different height or as a terminating profile of a flooring. The disadvantage thereof however is that because of the rectangular cross section which is necessary for manufacturing different floor profiles the chipping volume is relatively large when milling the floor profiles, which results in poor material exploitation.

To bridge a height difference between two flooring elements, a covering profile having two covering flanges protruding to both sides from a foot region has already been proposed (WO 03/040492), one of them cooperating with a levelling profile abutting the thinner one of the flooring elements forming the step and adjoining the underside of the one covering flange by means of a tongue and groove connection in order to bridge the height difference. The disadvantage in manufacturing such type covering and levelling profiles is above all the expense an individual production involves, more specifically if these profiles, which are preferably manufactured using an extrusion process, are to be subsequently coated on their visible side with a top coat glued thereon.

SUMMARY OF THE INVENTION

It is therefore the object of the invention to develop a method of the type described herein above for coating a covering profile and at least one levelling profile adapted to be adjoined with a covering flange of said covering profile of a covering device for floorings so as to allow for both the covering profile and the levelling profile to be coated in one work step with a top coat glued thereon, this being carried out encasing the lengthwise edges of the visible sides to be coated.

This object is solved in accordance with the invention in that the covering profile and the levelling profile connected through at least one web to the underside of the covering flange of the covering profile form the pre-profile, that the outer surfaces of the pre-profile forming the visible sides of the covering profile and of the levelling profile are coated each with one strip of the top coat projecting beyond the lengthwise edges of the visible sides and that, once the projecting strip portions of the top coat have been folded around the lengthwise edges of the visible sides, the web is sectioned between the covering profile and the levelling profile.

Since, as a result of these provisions, the covering profile and at least one levelling profile are combined into a pre-profile, the conditions for coating together these profiles united into a pre-profile are advantageous if the visible sides of these profiles are located in the region of the outer surfaces of the pre-profile. This is achieved in a simple manner by the fact that the levelling profile within the pre-profile is connected to the underside of one of the covering flanges of the covering profile so that the lengthwise edges of the visible faces of the covering flange and of the levelling profile are confronting each other. Accordingly, the visible faces of the covering profile and of the levelling profile may be coated each with a strip of the top coat in such a manner that strip portions of the top coat, which project beyond the lengthwise edges of the visible faces, are folded around these lengthwise edges to encase them. By sectioning the web thereafter, the pre-profile may then be divided into a covering profile coated on its visible side and into an also coated levelling profile.

In order to provide border portions of the top coat of sufficient width to encase the lengthwise edges of the visible sides of the covering profile and of the levelling profile in the region of the lengthwise edges turned toward each other, the visible sides of the covering profile and of the levelling profile may be coated with a common top coat bridging a free space between the lengthwise edges of the visible sides before the top coat is sectioned in the region of the free space and folded in strips around the lengthwise edges of the visible sides of the covering profile and of the levelling profile.

Another possibility is that the top coat is glued onto the pre-profile in strips overlapping each other in the region of a free space between the lengthwise edges of the visible sides of the covering profile and of the levelling profile before the strip portions projecting into the free space are folded around the lengthwise edges of the visible sides of the covering profile and of the levelling profile. In this case also, the part of the top coat strips which projects beyond the lengthwise edges of the visible sides to be coated and is intended to be folded around said lengthwise edges may be chosen large enough, with the material being utilized to advantage since no additional material is needed for processing.

BRIEF DESCRIPTION OF THE DRAWINGS

The method of the invention will be explained in closer detail with reference to the drawing. In said drawing.

DETAILED DESCRIPTION OF THE INVENTION

Figure 1:
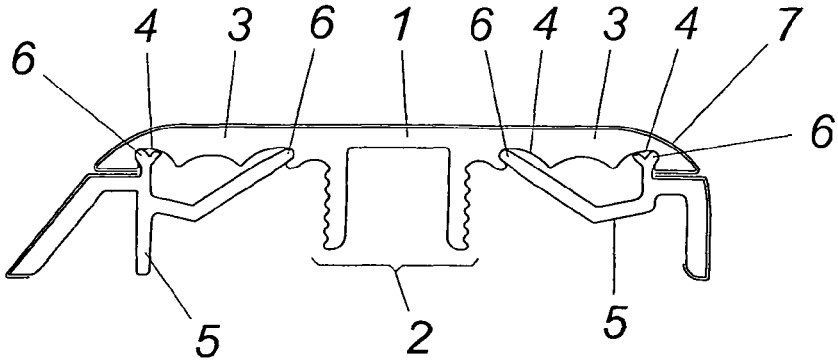
FIG. 1 shows a front-side view of a covering profile made using the method of the invention.

The covering profile 1 shown in FIG. 1 has a foot region 2 and two covering flanges 3 that project sideways from said foot region 2 and are provided on their underside with detent recesses 4 for optionally receiving a levelling profile 5. The levelling profiles 5, which, in contrast to the illustration shown in FIG. 1, are utilized optionally and singly only, form for this purpose detent lugs 6 engaging with the detent recesses 4 when the covering profile and a respective one of the levelling profiles 5 are being assembled. The provision of a covering profile 1 cooperating optionally with one of two levelling profiles 5 makes it possible to bridge expansion joints between flooring elements, to provide a transition between flooring elements of different height or to terminate the edges of a flooring, according to need. Whilst for covering an expansion joint the covering profile 1 is inserted alone, without levelling profile 5, by its foot region 2 into a floor rail provided in the expansion joint so as to straddle with its projecting covering flanges 3 the flooring elements on either side of the expansion joint, the covering profile 1 is coupled in the region of a covering flange 3 to a corresponding levelling profile 5 for levelling a height difference—be it in the region of the butt joint between flooring elements of different height or in the region of a flooring edge. If the covering profiles 1 used have a top coat 7, for example a decorative foil, a laminate or a veneer, on their visible side, the levelling profiles 5 also have to be provided with such a top coat 7 on their visible side.

Figure 2:
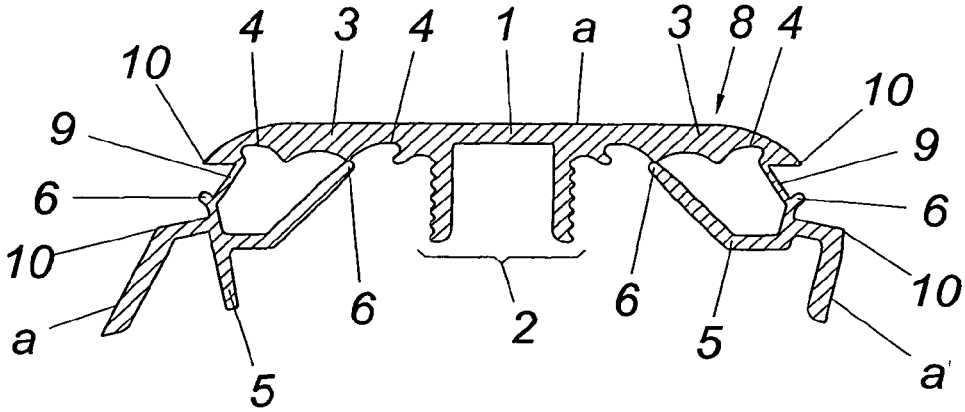
FIG. 2 shows a pre-profile for manufacturing a covering profile as well as two levelling profiles as shown in FIG. 1 in a cross sectional view and the FIGS. 3 through 5 show the making of the covering profile and of the levelling profiles using different method steps.

For ease of manufacturing profiles coated accordingly, a pre-profile 8 as shown in FIG. 2 is used as the starting material, said pre-profile being composed of the covering profile 1 and of the optionally insertable levelling profiles 5. They are arranged in such a manner that the visible sides a of the profiles 1 and 5 to be made fit against the outer surface of the pre-profile 8. For this purpose, the levelling profiles 5 are arranged in the space between the foot region 2 and a respective one of the covering flanges 3 of the covering profile 1 and are connected to the underside of the covering flanges 4 through at least one web 9 so that the confronting lengthwise edges 10 of the visible sides a of the profiles 1 and 5 are oriented in a spaced-apart relationship.

Figure 3:
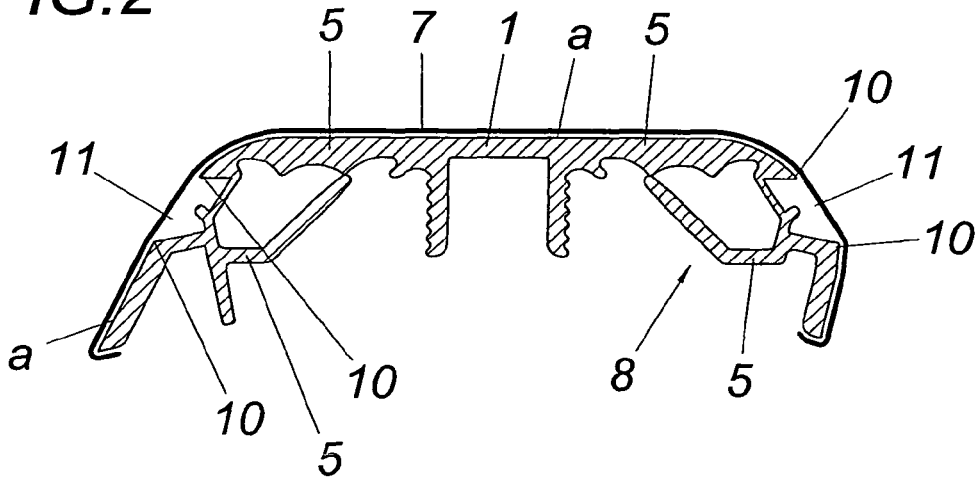
Figure 4:
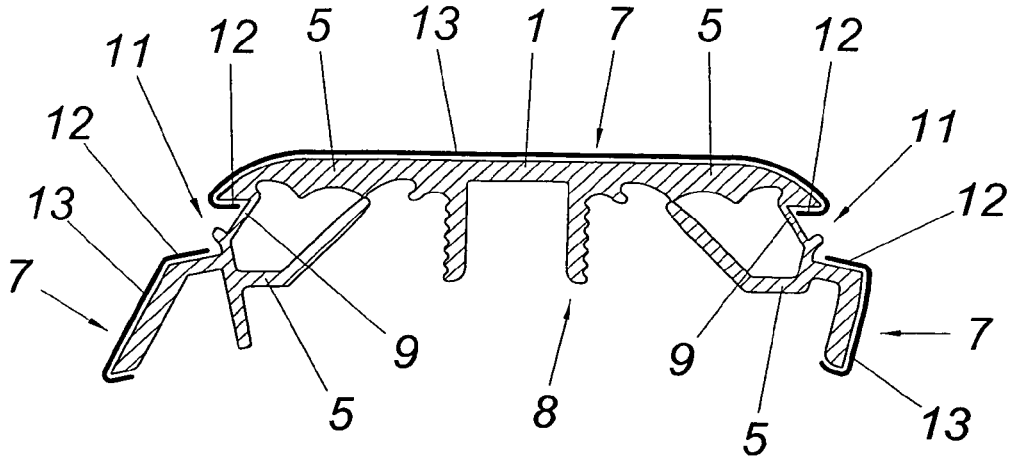
Figure 5:
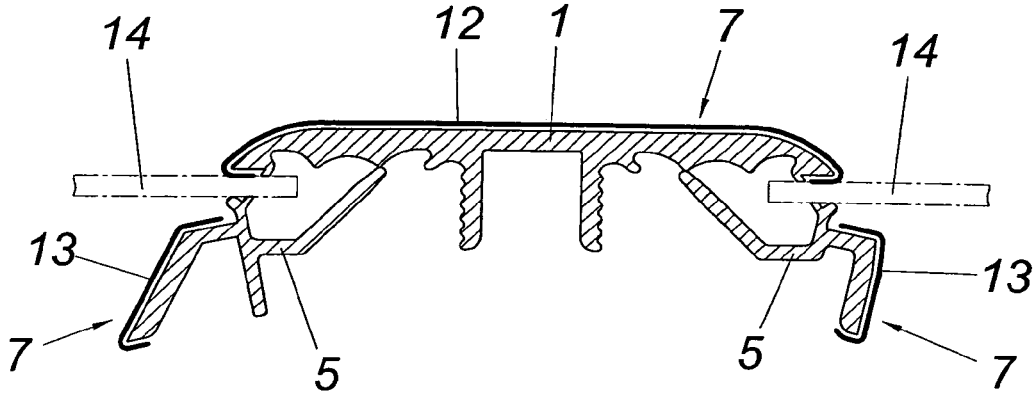

As shown in FIG. 3, the pre-profile 8 may be encased with a top coat 7 that is glued onto the visible sides of the covering profile 1 and of the levelling profiles 5, thereby bridging the free space 11 forming between the opposing lengthwise edges 10 of these visible faces a. Once the top coat 7 has been sectioned in the region of the free space 11, the strip portions 12 of top coat 7, which are divided into discrete strips 13 and project into said free space 11, may be folded around the lengthwise edges 10 and glued onto a respective one of the profile portions, as can be seen from FIG. 4. Next, the webs 9 between the covering flanges 3 of the covering profile 1 and the levelling profiles 5 are sectioned using saws 14 shown in dash-dotted lines in FIG. 5, the profiles 1 and 5 coated with a top coat 7 being obtained from pre-profile 8.

It is understood that the invention is not limited to the exemplary embodiment shown. Irrespective of the fact that different profile shapes may be united into a pre-profile 8, the top coat 7 needs not be glued in one piece onto the pre-profile 8. Said top coat 7 may be glued in strips corresponding to the discrete visible sides a if they project accordingly beyond the lengthwise edges 10 of the visible sides a so that the projecting strip portions may be folded around the lengthwise edges 10. For this purpose, it may be necessary, under certain circumstances, that the strips of the top coat 7 overlap in the region of the neighboring lengthwise edges 10 of the visible faces a.

The invention claimed is:

1. A method of coating with a top coat (7) a covering profile (1) and at least one levelling profile (5) adapted to be adjoined with a covering flange (3) of said covering profile (1) of a covering device for floorings, said top coat (7) being glued onto a pre-profile (8) before said covering profile (1) is worked from said preprofile (8) coated with said top coat (7), wherein said covering profile (1) and said levelling profile (5) connected through at least one web (9) to the underside of said covering flange (3) of said covering profile (1) form said preprofile (8), that the outer surfaces of said pre-profile (8) forming the visible sides of said covering profile (1) when said covering profile (1) is in use and of said levelling profile (5) when said levelling profile (5) is in use are coated each with one strip (13) of said top coat (7) projecting beyond the lengthwise edges (10) of said visible sides (a) and that, once the projecting strip portions (12) of said top coat (7) have been folded around said lengthwise edges (10) of said visible sides (a), said web (9) is sectioned between said covering profile (1) and said levelling profile (5).

2. The method as set forth in claim 1, wherein the visible sides (a) of the covering profile (1) and of the levelling profile (5) are coated together with a top coat (7) bridging a free space (11) between the lengthwise edges (10) of the visible sides (a) before said top coat (7) is sectioned in the region of said free space (11) and folded in strips around said lengthwise edges (10) of said visible sides (a) of said covering profile (1) and of said levelling profile (5).

3. The method as set forth in claim 1, wherein the top coat (7) is glued onto the pre-profile (8) in strips (13) possibly overlapping each other in the region of a free space (11) between the lengthwise edges (10) of the visible sides (a) of the covering profile (1) and of the levelling profile (5) before the strip portions (12) projecting into said free space (11) are folded around said lengthwise edges (10) of said visible sides (a) of said covering profile (1) and of said levelling profile (5).

* * * * *